US008194029B2

(12) United States Patent
Yeo et al.

(10) Patent No.: US 8,194,029 B2
(45) Date of Patent: Jun. 5, 2012

(54) DISPLAY DEVICE AND METHOD OF CONTROLLING THE SAME

(75) Inventors: Dong-hyun Yeo, Goyang-si (KR); Byung-kil Jeon, Anyang-si (KR); Nam-gon Choi, Asan-si (KR)

(73) Assignee: Samsung Electronics Co., Ltd. (KR)

( * ) Notice: Subject to any disclaimer, the term of this patent is extended or adjusted under 35 U.S.C. 154(b) by 869 days.

(21) Appl. No.: 12/273,361

(22) Filed: Nov. 18, 2008

(65) Prior Publication Data

US 2009/0128479 A1 May 21, 2009

(30) Foreign Application Priority Data

Nov. 21, 2007 (KR) ..... 10-2007-0119269

(51) Int. Cl.
*G09G 3/36* (2006.01)

(52) U.S. Cl. ..... 345/102; 345/82

(58) Field of Classification Search ..... 345/102, 345/82

See application file for complete search history.

(56) References Cited

U.S. PATENT DOCUMENTS 6,762,742 B2 * 7/2004 Moon et al. ..... 345/102
2002/0057238 A1 * 5/2002 Nitta et al. ..... 345/87

* cited by examiner

*Primary Examiner* — Kevin M Nguyen
*Assistant Examiner* — Sepideh Ghafari
(74) *Attorney, Agent, or Firm* — Innovation Counsel LLP

(57) ABSTRACT

A display device includes a driving signal generator being supplied with a synchronous signal and a clock signal and generating an inverter driving signal having a given frequency that is multiplied by a predetermined ratio from a frequency of the synchronous signal, an inverter outputting a driving signal based on the inverter driving signal, and a backlight unit controlling turned-on or turned-off based on the driving signal from the inverter. The driving signal generator operates the number of clocks of the clock signal included in a predetermined period of the synchronous signal by using a predetermined value, defines a magnitude of each section of the inverter driving signal with respect to the predetermined period of the synchronous signal, and adjusts the section magnitude of the inverter driving signal when the number of clocks differs from the total section magnitude of the inverter driving signal based on the magnitude of each section.

11 Claims, 3 Drawing Sheets

DISPLAY DEVICE AND METHOD OF CONTROLLING THE SAME

CROSS-REFERENCE TO RELATED APPLICATION

This application claims priority from Korean Patent Application No. 10-2007-0119269, filed on Nov. 21, 2007 in the Korean Intellectual Property Office, the disclosure of which is incorporated herein by reference.

BACKGROUND OF INVENTION

1. Field of Invention

The present invention relates to a display device and a control method thereof.

2. Description of the Related Art

A display device such as a liquid crystal display (LCD) includes a liquid crystal panel including a liquid crystal layer and displaying an image, a backlight unit to emit light on the liquid crystal panel and an inverter to drive the backlight unit.

The liquid crystal display includes a plurality of switching elements such as thin film transistors (TFTs) including semiconductor made of amorphous silicon (a-Si), a plurality of pixel electrodes, and a common electrode.

The amorphous silicon (a-Si) is sensitive to light. That is, a-Si TFT becomes conductive and its resistance is reduced when it receives light. When the light is removed, the a-Si TFT becomes semi-conductive and its resistance rises relatively to allow the thin film transistors to be affected by charging voltages of liquid crystal capacitors formed between the pixel electrodes and the common electrode. When light is emitted on an a-Si TFT the parasitic capacity of data lines is increased and a screen noise is created.

When the backlight unit emits light consistently to the liquid crystal panel, a liquid crystal panel receives light uniformly, which does not trigger any problem. However, a problem arises when brightness of the backlight unit is adjusted by an inverter driving signal generated by PWM (pulse-width modulation) which turns the backlight unit on and off periodically to improve display quality.

When a frequency ratio of a synchronous signal such as a vertical synchronous signal or a horizontal synchronous signal for controlling image display on the liquid crystal display does not coincide with the inverter driving signal, which is a PWM signal, regular movement of lines are observed in each frame, causing waterfall noise.

Thus, display devices have recently employed a synchronous inverter to synchronize the frequency of the synchronous signal and the frequency of the inverter driving signal, at a proper ratio to minimize such a noise.

At this time, magnitude of each high level section and each low level section of the inverter driving signal may be defined by using the number of clocks of a clock signal such as a main clock signal for being supplied with image signals corresponding each pixel of the liquid crystal display from an external or a data clock signal for applying to the image signals to corresponding pixels.

In more detail, when the inverter driving signal is generated in synchronization with the horizontal synchronous signal, the magnitude of the sections of the inverter driving signal is defined based on the number of clocks of the clock signal for pixels of one pixel row. When the inverter driving signal is generated in synchronization with the vertical synchronous signal, the magnitude of the sections of the inverter driving signal is defined based on the number of clocks of the clock signal for pixels of the number of predetermined pixel rows.

However, in the synchronization of the synchronous signal and the inverter driving signal in the conventional display device, errors are excessively generated such that a flicking error, etc. occurs.

Particularly, when the inverter driving signal is generated in synchronization with the horizontal synchronous signal, much noise due to the asynchronization does not create because the number of pixels with synchronous relationship with the inverter driving signal is not many such the pixels of one pixel row. However, when the inverter driving signal is generated in synchronization with the vertical synchronous signal, the number of pixels of synchronous relationship with the inverter driving signal is many such (the number of pixel rows×the number of pixels for one pixel), even if one of all pixel rows is asynchronous, the number of pixels having the asynchronous relationship with the inverter driving signal largely increases. Thereby images are shaky and flicker occurs.

SUMMARY OF THE INVENTION

The foregoing and/or other embodiments of the present invention can be achieved by providing a display device, including: a driving signal generator being supplied with a synchronous signal and a clock signal and generating an inverter driving signal having a given frequency that is multiplied by a predetermined ratio from a frequency of the synchronous signal, an inverter outputting a driving signal based on the inverter driving signal, and a backlight unit controlling turned-on or turned-off based on the driving signal from the inverter, wherein the driving signal generator operates the number of clocks of the clock signal included in a predetermined period of the synchronous signal by using a predetermined value, defines a magnitude of each section of the inverter driving signal with respect to the predetermined period of the synchronous signal, and adjusts the section magnitude of the inverter driving signal when the number of clocks differs from the total section magnitude of the inverter driving signal based on the magnitude of each section.

The driving signal generator may divide the number of clocks of the clock signal in the predetermined period of the synchronous signal by the predetermined value to define the magnitude of each section of the inverter driving signal, and adjust the magnitude of section based on the remainder of the division when the remainder exists.

The driving signal generator may adjust the magnitude from the first section among the plurality of sections of the inverter driving signal.

The predetermined value may be defined based on the multiplying value.

The synchronous signal may include at least one of a horizontal synchronous signal and a vertical synchronous signal.

The clock signal may include at least one of a main clock signal and a data clock signal. The foregoing and/or other embodiments of the present invention can be achieved by providing method of controlling a display device, the method including adjusting a section magnitude of an inverter driving signal by dividing the number of clocks of a clock signal in a predetermined period of a synchronous signal by a multiplying corresponding to a frequency of the synchronous signal and a frequency of the inverter driving signal, adjusting the magnitude of section based on a remainder of the division of the division when the remainder exists, wherein the number of adjusted section being the same as the remainder, and driving the backlight unit based on the inverter driving signal.

The adjusting the section magnitude may include adjusting the magnitude from the first section among the plurality of sections of the inverter driving signal.

The predetermined value may be defined based on the multiplying value.

The synchronous signal may include at least one of a horizontal synchronous signal and a vertical synchronous signal.

The clock signal may include at least one of a main clock signal and a data clock signal.

BRIEF DESCRIPTION OF THE DRAWINGS

The above and/or other embodiments of the present invention will become apparent and more readily appreciated from the following description of the exemplary embodiments, taken in conjunction with the accompanying drawings, in which.

DETAILED DESCRIPTION OF EXEMPLARY EMBODIMENTS OF THE INVENTION

Figure 1:
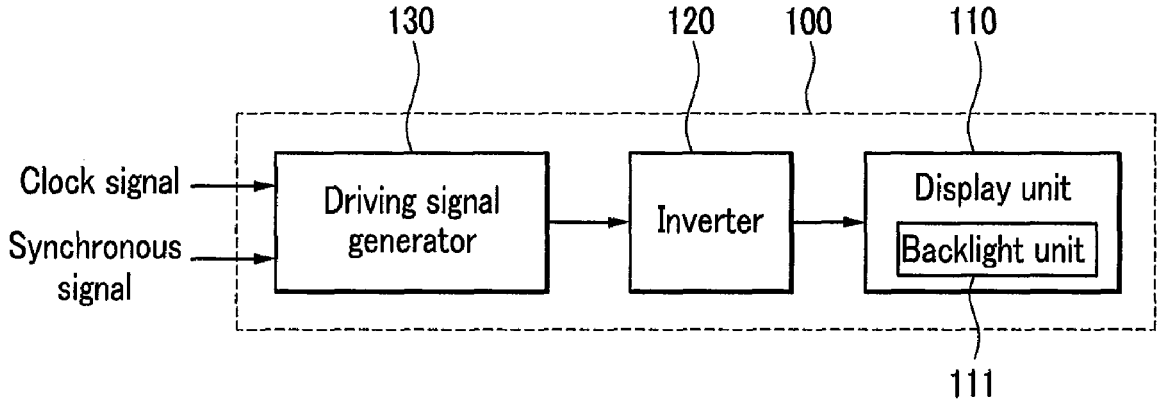
FIG. 1 is a block diagram of a display device according to an exemplary embodiment of the present invention.

Reference will now be made in detail to describe the embodiments of the present invention, examples of which are illustrated in the accompanying drawings. Like reference numerals refer to like elements throughout. The embodiments are described below so as to explain the present invention by referring to the figures.

FIG. 1 is a block diagram of a display device according to an exemplary embodiment of the present invention.

As shown in FIG. 1, the display device 100 includes a display unit 110, an inverter 120, and a driving signal generator 130. For example, the display device 100 may be a liquid crystal display.

The display unit 110 includes a plurality of pixels and displays an image thereon.

The display unit 110 also includes a liquid crystal panel (not shown) and a backlight unit (111) emitting light to the liquid crystal panel.

The backlight unit may include a plurality of light elements such as a light emitting diode (LED), a cold cathode fluorescent lamp (CCFL), a hot cathode fluorescent lamp (HCFL) and the like.

The inverter 120 supplies a driving signal to the backlight unit 111 to drive the backlight unit 111. More specifically, the inverter 120 supplies the driving signal to the backlight unit 111 of the display unit 110 according to an inverter driving signal that has a predetermined duty ratio.

The inverter 120 may include a plurality of switching elements (not shown) and turn on and off the plurality of switching elements according to the inverter driving signal to supply the driving signal to the backlight unit 111. The driving signal generator 130 generates the inverter driving signal which has a frequency which is multiplied by a predetermined ratio from a frequency of a synchronous signal inputted.

In the embodiment, the synchronous signal may be at least one of a horizontal synchronous signal and a vertical synchronous signal.

The driving signal generator 130 may generate an inverter driving signal in synchronization with at least one of the horizontal synchronous signal and the vertical synchronous signal. More specifically, the driving signal generator 130 generates an inverter driving signal by a pulse width modulation (PWM) to turn on and off the backlight unit 111 of the display unit 110 periodically. The driving signal generator 130 synchronizes the frequency of the synchronous signal and the frequency of the PWM signal, i.e., frequency of an inverter driving signal, at a predetermined ratio.

For example, the frequency ratios of the synchronous signal and the inverter driving signal may be to generate the least waterfall noise.

As one example, when the inverter driving signal is generated by using the horizontal synchronous signal, a multiplying value of the frequency of the inverter driving signal with respect to the horizontal synchronous signal may be about 2/3. That is, during about three periods of the horizontal synchronous signal, the inverter driving signal of about two periods is generated. When the inverter driving signal is generated by using the vertical synchronous signal, a multiplying value of the frequency of the inverter driving signal with respect to the vertical synchronous signal may be about 5/2. That is, during about two periods of the vertical synchronous signal, the inverter driving signal of about five periods is generated.

At this time, magnitude of each high level section and each low level section is defined based on the number of clocks of a clock signal such as a main clock signal or a data clock signal.

The driving signal generator 130 operates so that a magnitude difference between a plurality of sections of the inverter driving signal generated within a predetermined period of the synchronous signal is equal to or less than a predetermined value.

More specifically, the driving signal generator 130 divides the number of clocks of the clock signal, which is a main clock signal or a data clock signal, included in a predetermined period of the synchronous signal by a predetermined value defined based on a multiplying value, to define the magnitude of each section of the inverter driving signal, and then adjusts the magnitude of each section in accordance with the number of remaining clocks (remaining value) when the remaining value exists.

That is, the driving signal generator 130 divides the total number of clocks of the clock signal input for a predetermined period of the synchronous signal by the multiplying value and defines the magnitude of the sections, such that the driving signal generator 130 synchronizes the synchronous signal and the inverter driving signal to decrease the magnitude difference between the sections of the inverter driving signal.

The driving signal generator 130 sequentially adjusts from preceding sections among the high level and low level sections of the inverter driving signal generated within in a predetermined period of the synchronous signal. At this time, preferably, the driving signal generator 130 controls the section magnitude of the inverter driving signal to minimize the magnitude difference between sections. Next, the operations of the driving signal generator 130 generating the inverter driving signal by synchronizing with the vertical synchronous signal will be described.

When the total number of clocks of the clock signal included in two periods of a vertical synchronous signal is 2002 (≈the pixel row number of two frames×the pixel number of one pixel row) and when the multiplying value is about 5/2, that is, when the inverter driving signal of about five periods is generated during the vertical synchronous signal of about two periods, the driving signal generator 130 defines a reference value of the section magnitude of the inverter driving signal for one period of the vertical synchronous signal using a value close to the total clock number. The inverter driving signal generated during two periods of the vertical synchronous signal includes the total ten sections having five high level sections and five low level sections.

At this time, the reference value is a value counted in 10 (=5×2) defined based on the multiplying value 5/2

The total number of clocks of the clock signal included in one period of the vertical synchronous signal is about 1001 (=2002/2). In counting by 10 units, 1001 exists between 1000 and 1010.

That is, since 1001 is larger than 1000 and smaller than 1010, the reference value of the inverter driving signal with respect to the vertical synchronous signal of one period may be one of 1000 and 1010.

When the driving signal generator selected a larger value, i.e., 1010 as the reference value, 1010 clocks is divided by 10 and 101 clocks is gotten. Thereby, the section magnitude of the inverter driving signal with respect to one period of the vertical synchronous signal is about 101, and the section magnitude of the inverter driving signal with respect to two period of the vertical synchronous signal is about 202 clocks (=101×2). However, the final section, i.e., the tenth section of the inverter driving signal has the magnitude of about 184 clocks, which about 18 clocks is less than that the remaining sections. Thereby, a flicker occurs due to the magnitude difference between the last section and the remaining sections.

Figure 2:
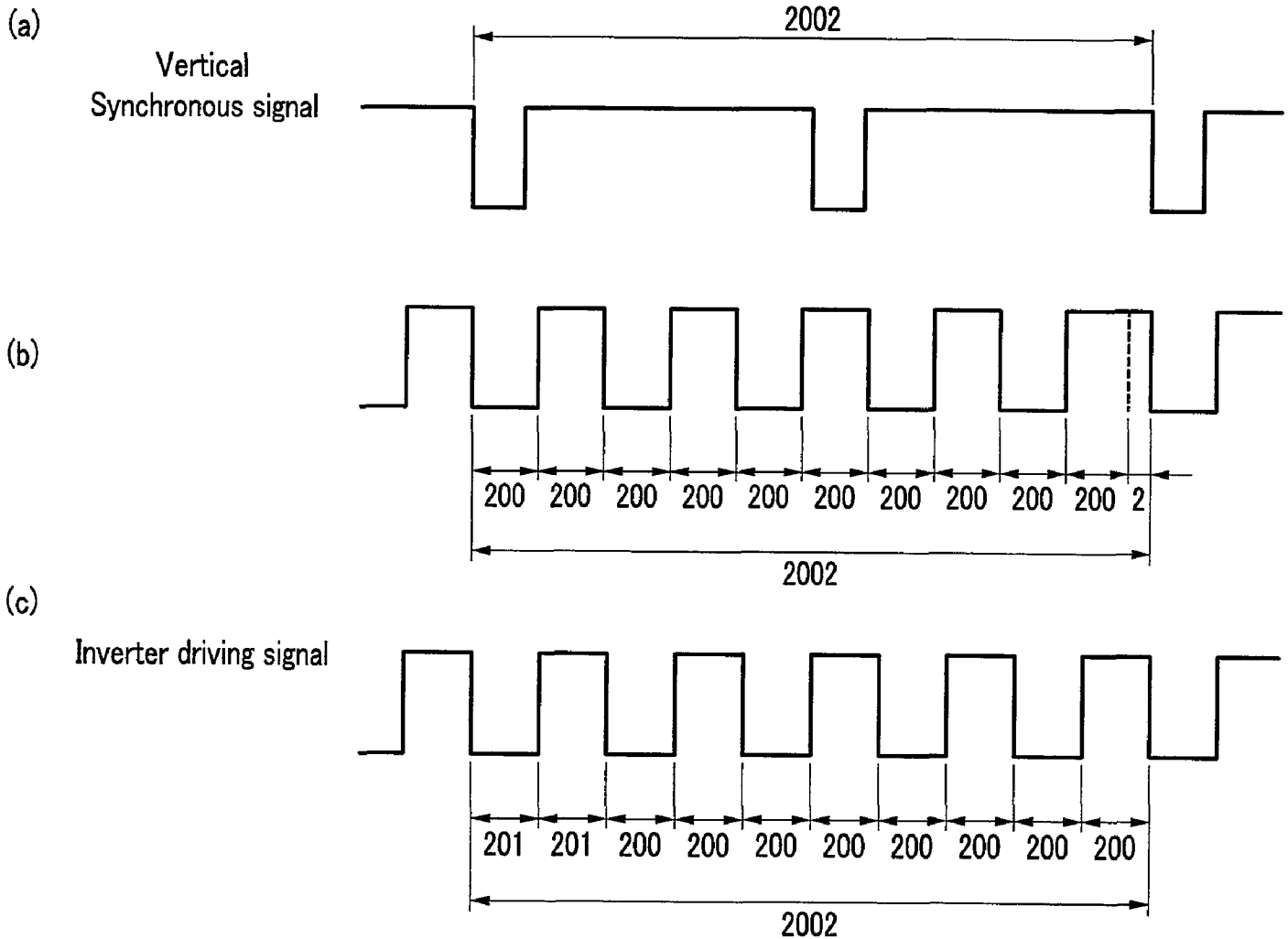
FIG. 2 is a timing diagram of an inverter driving signal that is synchronized with a synchronous signal of a display device according to an exemplary embodiment of the present invention.

In the display device 100 according to an embodiment of the present invention, as shown in (a) of FIG. 2, it is assumed that a frequency multiplying value of an inverter driving signal with respect to a vertical synchronous signal is about 5/2 and the total number of clocks of a clock signal within two periods of the vertical synchronous signal is about 2002.

The driving signal generator 130 counts 2002 clocks in tens based on the multiplying value to determine a reference value of the inverter driving signal with respect to one period of the vertical synchronous signal.

However, unlike the previous supposition, the driving signal generator 130 of the display device 100 selects 1000, i.e., a smaller value, as the reference value.

Thus, 1000 clocks are divided by 10, and then 100 is obtained. Accordingly, the section magnitude of the inverter driving signal with respect to the vertical synchronous signal of two periods is defined about 200 (=100×2), and the total clock number of ten sections of the inverter driving signal is about 2000 [refer to (b) of FIG. 2].

As compared to about 2002 clocks generated two period of the vertical synchronous signal, the total clock number lacks two clocks (=2002−2000).

For synchronizing the clock signal and the inverter driving signal, two remaining clocks are sequentially added to two sections the inverter driving signal from the first section by one clock, to adjust the magnitude of the first and second sections to 201 clocks, as shown in (c) of FIG. 2.

Next, as another exemplary embodiment of the present invention, it is assumed that the total number of clocks of a clock signal for two periods of a vertical synchronous signal is 2020 and a multiplying value of an inverter driving signal with respect to the vertical synchronous signal is about 5/2.

In selecting a reference value for the section magnitude of the inverter driving signal with respect to the vertical synchronous signal of one period, 1010 which is equal to the total clock number of the clock signal with respect to one period of the vertical synchronous signal is selected. Thus, the magnitude of each section of the inverter driving signal with respect to the vertical synchronous signal of two periods becomes 202 clocks. Since the reference value is equal to the total clock number of the clock signal with respect to one period of the vertical synchronous signal, there is no need to adjust the section magnitude of the inverter driving signal. Accordingly, all the sections of the inverter driving signal have the same magnitude.

As a result, when a multiple value of a predetermined value based on the multiplying value is the same as the number of clocks of the clock signal input for a predetermined period of a synchronous signal, all the sections of the inverter driving signal have the same magnitude and thereby it does not need to adjust the sections.

Therefore, in the display device 100 according to an embodiment, the inverter driving signal is synchronized with a synchronous signal and the magnitude difference between the sections of the inverter driving signal minimizes to decrease noise such as flickering.

In the embodiment, when the section magnitude of an inverter driving signal generated for a predetermined period of a synchronous signal is defined, the driving signal generator 130 calculates a reference value for the section magnitude of the inverter driving signal by using the number of clocks of a clock signal input for one period of the synchronous signal and then defines the section magnitude of the inverter driving signal generated for the predetermined period of the synchronous signal. However, the driving signal generator 130 may define the reference value for the section magnitude of the inverter driving signal by using the total number of clocks of a clock signal input for a predetermined period of the synchronous signal.

For example, when it is assumed that a frequency multiplying value of an inverter driving signal with respect to a vertical synchronous signal is about 5/2 and the total number of clocks of a clock signal within two periods of the vertical synchronous signal is about 2002, the driving signal generator 130 selects 2000 of 2000 and 2010 as a reference value. Thereby, the result value 200 obtained by dividing 2000 by 10 based on the multiplying value becomes the magnitude of each section of the inverter driving signal. At this time, two clocks, which lack to be 2002 clocks, are supplemented by adjusting the magnitude of the first and second sections of the inverter driving signal to 201 clocks.

As a result, the driving signal generator 130 according to an embodiment of the present invention divides the total number of clocks of a clock signal included in a predetermined period of a synchronous signal by a predetermined value based on a multiplying value to define the magnitude of each section of the inverter driving signal generated for the predetermined period of the synchronous signal. Next, when the remainder exists, the driving signal generator 130 sequentially adjusts the magnitude of sections from the first section by one clock. At this time, the number of sections being adjusted is the same as the remainder.

The driving signal generator 130 referring to FIG. 2 generates an inverter driving signal using a vertical synchronous signal, but may use a horizontal synchronous signal.

Figure 3:
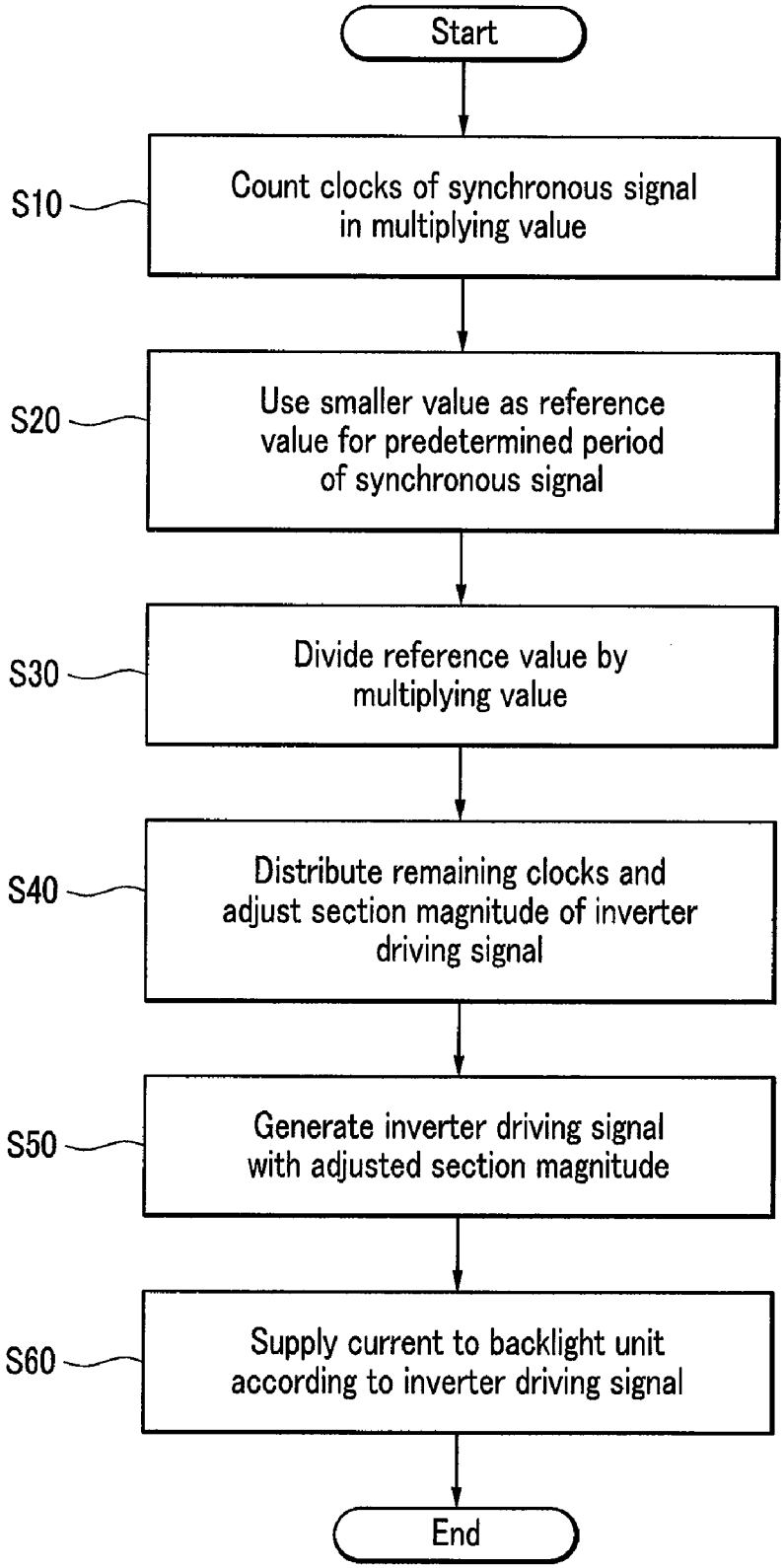
FIG. 3 is a flowchart showing an operation of the display device according to an exemplary embodiment of the present invention.

Hereinafter, the operations of a display device 100 according to an exemplary embodiment of the present invention will be described with reference to FIG. 3.

First, the driving signal generator 130 of the display apparatus 100 counts the number of clocks of a clock signal included in a predetermined period of a synchronous signal by a value based on multiplying value corresponding to the frequency of the synchronous signal and the frequency of the inverter driving signal (S10).

The driving signal generator 130 selects a smaller value as a reference value for a section magnitude of the inverter driving signal with respect to a predetermined period of the synchronous signal (S20).

The driving signal generator 130 divides the reference value by a predetermined value based on the multiplying value to define the section magnitude of the inverter driving signal (S30). The driving signal generator 130 distributes the remainder of the division to adjust the section magnitude of the inverter driving signal when the remainder exists (S40).

Therefore, the driving signal generator 130 generates the inverter driving signal with the adjusted section magnitude (S50).

The inverter 120 generate a driving signal based on the inverter driving signal and supplies current to the backlight unit 111 according to the driving signal (S60). Thus, the backlight unit 111 turns on or off.

That is, the driving signal generator 130 generates the inverter driving signal having a frequency multiplied by a predetermined ratio from the frequency of the synchronous signal. The inverter 120 supplies the driving signal to the backlight unit of the backlight unit 111 according to the inverter driving signal.

In embodiment of the present invention, the number of clocks of a clock signal may be the number of low levels as well as that of high levels.

In this embodiment, one pixel may include three pixels of a red pixel, a green pixel, and a blue pixel or may four pixels of a white pixel and the three pixels. However, alternatively, one pixel may be each of the three pixels or the four pixels.

As described above, the present invention provides a display apparatus which reduces synchronization errors of a synchronous signal and an inverter driving signal, and a control method thereof.

Although a few exemplary embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A display device, comprising:

a driving signal generator being supplied with a synchronous signal and a clock signal and generating an inverter driving signal having a given frequency that is multiplied by a predetermined ratio from a frequency of the synchronous signal;

an inverter outputting a driving signal based on the inverter driving signal; and a backlight unit controlling turned-on or turned-off based on the driving signal from the inverter, wherein the driving signal generator operates the number of clocks of the clock signal included in a predetermined period of the synchronous signal by using a predetermined value, defines a magnitude of each section of the inverter driving signal with respect to the predetermined period of the synchronous signal, and adjusts the section magnitude of the inverter driving signal when the number of clocks differs from the total section magnitude of the inverter driving signal based on the magnitude of each section.

2. The display device of claim 1, wherein the driving signal generator divides the number of clocks of the clock signal in the predetermined period of the synchronous signal by the predetermined value to define the magnitude of each section of the inverter driving signal, and adjusts the magnitude of section based on the remainder of the division when the remainder exists.

3. The display device of claim 2, wherein the driving signal generator adjusts the magnitude from the first section among the plurality of sections of the inverter driving signal.

4. The display device of claim 1, wherein the predetermined value is defined based on the predetermined ratio.

5. The display device of claim 1, wherein the synchronous signal comprises at least one of a horizontal synchronous signal and a vertical synchronous signal.

6. The display device of claim 1, wherein the clock signal comprises at least one of a main clock signal and a data clock signal.

7. A method of controlling a display device comprising a backlight unit, the method comprising:

adjusting a section magnitude of an inverter driving signal by dividing the number of clocks of a clock signal in a predetermined period of a synchronous signal by a multiplying value corresponding to a frequency of the synchronous signal and a frequency of the inverter driving signal;

adjusting the magnitude of section based on a remainder of the division when the remainder exists, wherein the number of adjusted sections being the same as the remainder; and driving the backlight unit based on the inverter driving signal.

8. The method of claim 7, wherein the adjusting the section magnitude comprises adjusting the magnitude from the first section among the plurality of sections of the inverter driving signal.

9. The method of claim 7, wherein the multiplying value is defined based on a predetermined ratio of the frequency of the synchronous signal and the frequency of the inverter driving signal.

10. The method of claim 7, wherein the synchronous signal comprises at least one of a horizontal synchronous signal and a vertical synchronous signal.

11. The method of claim 7, wherein the clock signal comprises at least one of a main clock signal and a data clock signal.

* * * * *